US008180096B2

(12) United States Patent
Sano et al.

(10) Patent No.: US 8,180,096 B2
(45) Date of Patent: May 15, 2012

(54) LOUDSPEAKER

(75) Inventors: Koji Sano, Mie (JP); Kazuki Honda, Mie (JP); Satoshi Itoh, Mie (JP); Masashi Kawabe, Mie (JP)

(73) Assignee: Panasonic Corporation, Osaka (JP)

( * ) Notice: Subject to any disclaimer, the term of this patent is extended or adjusted under 35 U.S.C. 154(b) by 504 days.

(21) Appl. No.: 11/994,880

(22) PCT Filed: Sep. 28, 2007

(86) PCT No.: PCT/JP2007/068953
§ 371 (c)(1),
(2), (4) Date: Jan. 7, 2008

(87) PCT Pub. No.: WO2008/038759

PCT Pub. Date: Apr. 3, 2008

(65) Prior Publication Data

US 2010/0128917 A1 May 27, 2010

(30) Foreign Application Priority Data

Sep. 29, 2006 (JP) ..... 2006-267658
Sep. 29, 2006 (JP) ..... 2006-267659
Sep. 29, 2006 (JP) ..... 2006-267660
Sep. 29, 2006 (JP) ..... 2006-267663

(51) Int. Cl.
*H04R 11/02* (2006.01)

(52) U.S. Cl. ..... 381/396; 381/398; 381/429; 181/161; 181/171

(58) Field of Classification Search ..... 381/396
See application file for complete search history.

(56) References Cited

U.S. PATENT DOCUMENTS 6,920,230 B2 * 7/2005 Usuki et al. ..... 381/396

(Continued)

FOREIGN PATENT DOCUMENTS

JP 2000-152378 5/2000

(Continued)

OTHER PUBLICATIONS

International Search Report.

(Continued)

*Primary Examiner* — Angel Roman
(74) *Attorney, Agent, or Firm* — Pearne & Gordon LLP

(57) ABSTRACT

A loudspeaker includes a first bar magnet having a longitudinal direction, a second bar magnet having a longitudinal direction parallel to the longitudinal direction of the first bar magnet, a third bar magnet forming a second magnetic gap between the first bar magnet and the third bar magnet, a diaphragm arranged to vibrate in a vibrating direction, a case accommodating the first bar magnet, the second bar magnet, the third bar magnet, and the diaphragm , and the voice coil fixed to the diaphragm and located in the first and second magnetic gaps. The second bar magnet has a longitudinal direction parallel to the longitudinal direction of the first bar magnet, and has both ends in the longitudinal direction. The third bar magnet has a longitudinal direction parallel to the longitudinal direction of the first bar magnet, and has both ends in the longitudinal direction. The diaphragm is located between the first and second bar magnets and between the first and third bar magnents. The case is made of non-magnetic material and holds an outer periphery of the diaphragm. The case forms a first space surrounded by the case, one of the both ends of the second bar magnet, and one of the both ends of the third bar magnet. The case forms a second space surrounded by the case, another one of both ends of the second bar magnet, and another one of both ends of the third bar magnet. First and second sound holes are provided in the case and communicate with the first and second spaces, respectively. The loudspeaker is thin but outputs large sounds.

10 Claims, 6 Drawing Sheets

U.S. PATENT DOCUMENTS

2006/0088180 A1* 4/2006 Kaiya et al. ..... 381/397
2007/0165902 A1* 7/2007 Matsumura et al. ..... 381/396

FOREIGN PATENT DOCUMENTS

JP 2005-051283 2/2005
WO 2006080405 A1 8/2006

OTHER PUBLICATIONS

Supplementary European Search Report for Appl. EP 07828694 dated Jun. 17, 2010.

* cited by examiner

LOUDSPEAKER

TECHNICAL FIELD

The present invention related to a thin loudspeaker.

BACKGROUND ART

Electronic devices, such as mobile phones, has been recently demanded to be thin, accordingly requiring thin loudspeakers accommodated in cases of the devices.

In order to allow a conventional loudspeaker disclosed in patent document 1 below to be thin, a magnet forming a magnetic circuit necessarily has a small size. Such a small magnet provides inevitably a small magnetic force, accordingly generating a small sound output. Hence, the magnet cannot be small, and accordingly, prevents the loudspeaker from being thin.

Patent Document 1: Japanese Patent Laid-Open Publication No. 2005-51283

SUMMARY OF THE INVENTION

A loudspeaker includes a first bar magnet having a longitudinal direction, a second bar magnet forming a first magnetic gap between the first bar magnet and the second bar magnet, a third bar magnet forming a second magnetic gap between the first bar magnet and the third bar magnet, a diaphragm arranged to vibrate in a vibrating direction, a case magnet, and the diaphragm, and a voice coil fixed to the diaphragm and located in the first and second magnetic gaps. The second bar magnet has a longitudinal direction parallel to the longitudinal direction of the first bar magnet, and has both ends in the longitudinal direction. The third bar magnet has a longitudinal direction parallel to the longitudinal direction of the first bar magnet, and has both ends in the longitudinal direction. The diaphragm is located between the first and second bar magnets and between the first and third bar magnets. The case is made of non-magnetic material and holds an outer periphery of the diaphragm. The case forms a first space surrounded by the case, one of the both ends of the second bar magnet, and one of the both ends of the third bar magnet. The case forms a second space surrounded by the case, another one of the both ends of the second bar magnet, and another one of the both ends of the third bar magnet. First and second sound holes are provided in the case and communicate with the first and second spaces, respectively.

The loudspeaker is thin but outputs large sounds.

REFERENCE NUMERALS

7 Sound Hole
10 Yoke
11 First Bar Magnet
13F Vibrating Direction
13 Diaphragm
14 Voice Coil
14A End
15 Second Bar Magnet
16 Yoke
18 Through-Hole
34 Case
81 First Magnetic Gap
82 Second Magnetic Gap
115 Third Bar Magnet
116 Yoke

DETAILED DESCRIPTION OF THE PREFERRED EMBODIMENT

Figure 1:
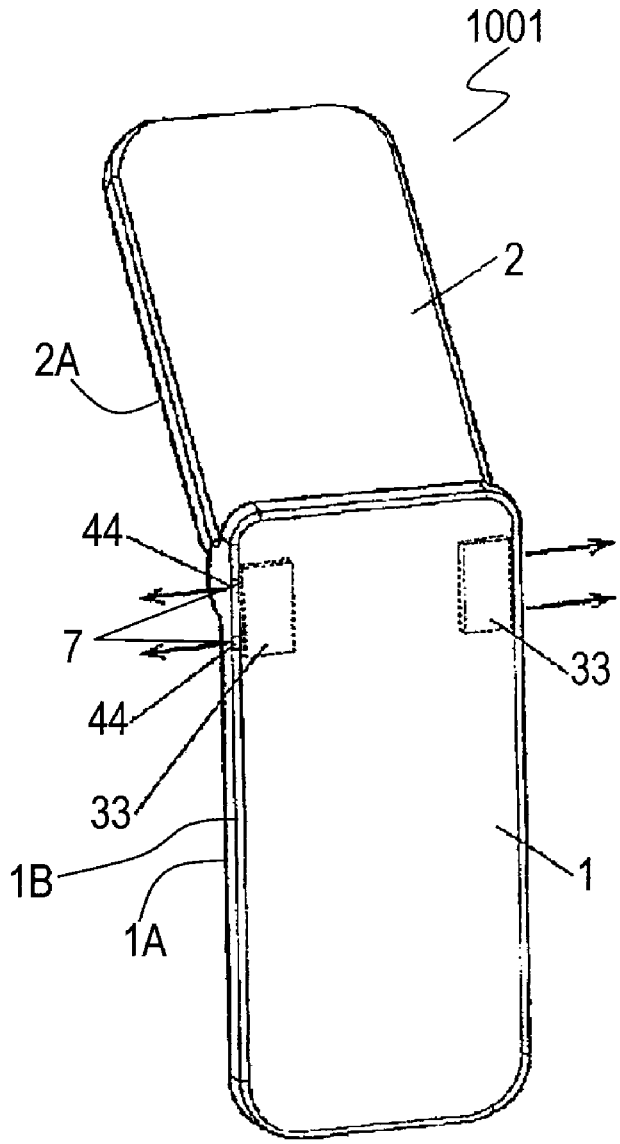
FIG. 1 is a perspective view of an electronic device including a loudspeaker according to an exemplary embodiment of the present invention.

FIG. 1 is a perspective view of mobile phone 1001, an electronic device according to an exemplary embodiment. Mobile phone 1001 includes body 1, lid 2 coupled movably to body 1, an operation button provided on surface 1A of body 1, and a liquid crystal display provided on surface 2A of lid 2. Body 1 accommodates loudspeaker 33 therein. Loudspeaker 33 has sound holes 7 communicating with sound holes 44 provided in outer side surface 1B, respectively.

Figure 2:
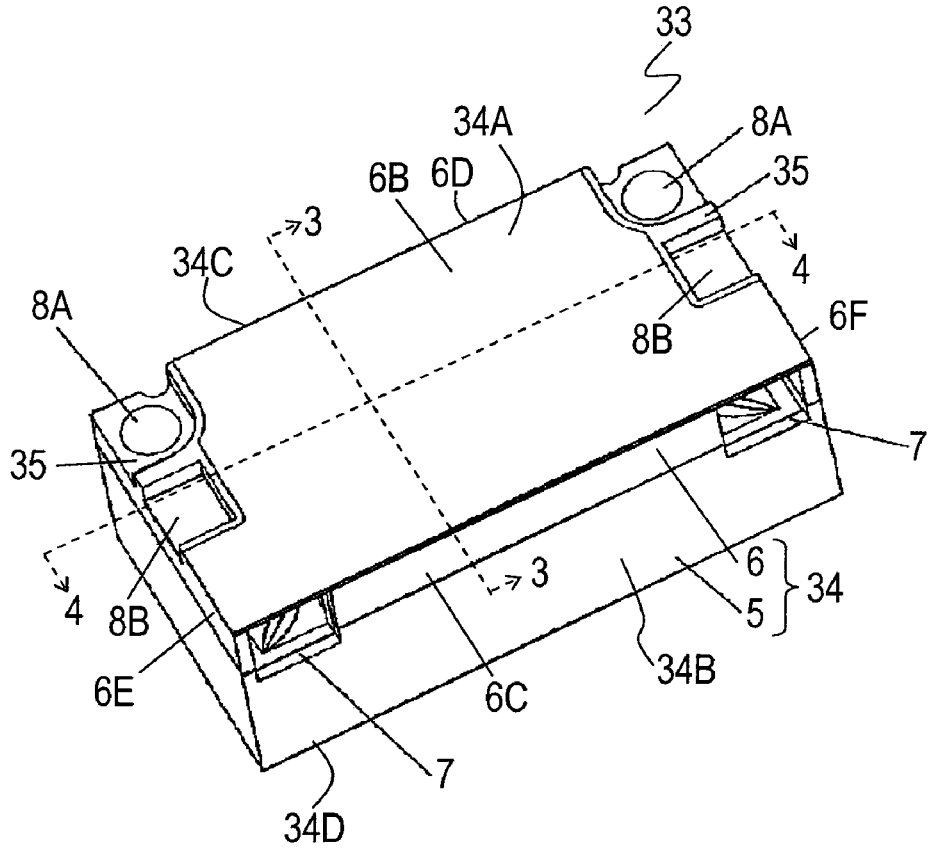
FIG. 2 is a perspective view of the loudspeaker according to the embodiment.

FIG. 2 is a perspective view of loudspeaker 33. Loudspeaker 33 includes case 34 made of non-magnetic material. Case 34 includes lower case 5 and upper case 6 that are different members from each other. Case 34 has a substantially rectangular parallelepiped shape having upper surface 34A, lower surface 34D opposite to upper surface 34A, side surface 34B, and side surface 34C opposite to side surface 34B. Sound holes 7 are provided in both ends of side surface 34B, and communicate with a vibration space in case 34. Terminal plate 35 is provided on upper surface 34A of case 34, specifically, near side surface 34C of case 34. Terminal plate 35 has joint section 8A and terminal section 8B for connecting loudspeaker 33 to an external circuit, such as an amplifier.

Figure 3:
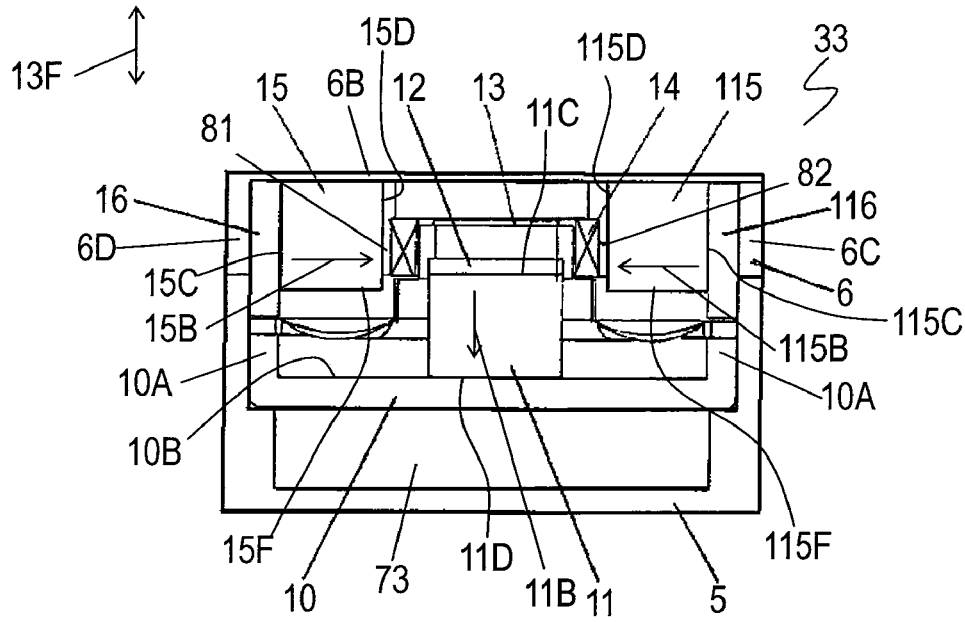
FIG. 3 is a cross-sectional view of the loudspeaker at line 3-3 shown in FIG. 2.
Figure 4:
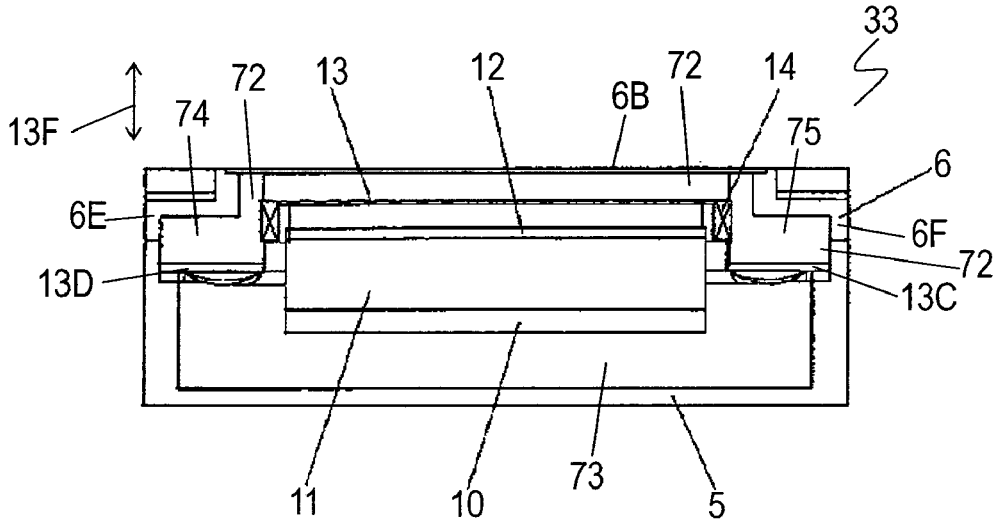
FIG. 4 is a cross-sectional view of the loudspeaker at line 4-4 shown in FIG. 2.
Figure 5:
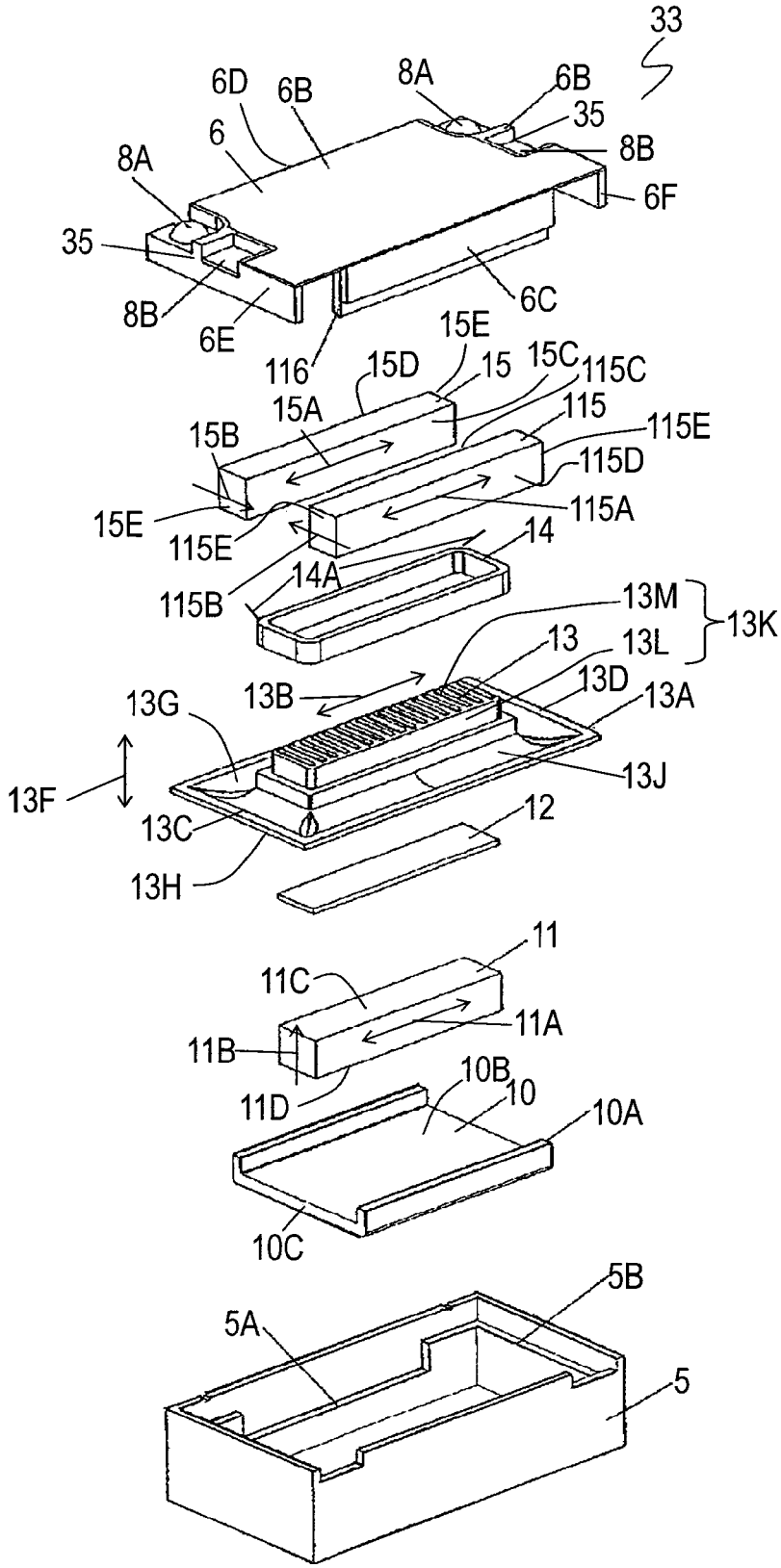
FIG. 5 is an exploded perspective view of the loudspeaker according to the embodiment.

FIG. 3 is a cross-sectional view of loudspeaker at line 3-3 shown in FIG. 2. FIG. 4 is a cross-sectional view of loudspeaker at line 4-4 shown in FIG. 2. FIG. 5 is an exploded perspective view of loudspeaker 33. Yoke 10 has a flat plate shape and is made of magnetic material. Yoke 10 has flat portion 10C and shoulder 10A provided disposed at each of both ends of flat portion 10C. Yoke 10 has a cross section having a substantially squared U-shape. First bar magnets 11 has longitudinal direction 11A, and is magnetized in direction 11B perpendicular to longitudinal direction 11A. Second bar magnet 15 has longitudinal direction 15A, and is magnetized in direction 15B perpendicular to longitudinal direction 15A. Third bar magnet 115 has longitudinal direction 115A, and is magnetized in direction 115B perpendicular to longitudinal direction 115A. Lower surface 11D of first bar magnet 11 is coupled onto the middle portion of upper surface 10B of yoke 10 such that longitudinal direction 11A of first bar magnet 11 is parallel with shoulder 10A. Plate 12 made of magnetic material is attached onto upper surface 11C of first bar magnet 11. Yoke 10 is accommodated in the middle portion of lower case 5 which forms vibration space 73 below yoke 10 attached onto surface 11D. Second bar magnet 15 has both ends 15E in longitudinal direction 15A. Third bar magnet 115 has both ends 115E in longitudinal direction 115A. Diaphragm 13 is located between first bar magnet 11 and second bar magnet 15 and between first bar magnet 11 and third bar magnet 115. Case 34 provides space 74 surrounded by one of both ends 15E of second bar magnet 15 and one of both ends 115E of third bar magnet 115. Case 34 also provides space 75 surrounded by another one of both ends 15E of 15E of second bar magnet 15 and another one of both ends 115E of third bar magnet 115. Case 34 supports outer periphery 13A of diaphragm 13 and accommodates bar magnets 11, 15, and 115, and diaphragm 13 therein.

Shoulder 10A of yoke 10 is mounted in recess 5A provided inside lower case 5 such that the upper surface of shoulder 10A is flush with the upper surface of step portion 5B provided inside lower case 5.

Voice coil 14 having an oval shape is fixed to diaphragm 13. Outer periphery 13A of diaphragm 13 is secured with adhesive on step portion 5B of lower case 5 and shoulder 10A of yoke 10 which are flush with each other. Ends 14A of voice coil 14 are soldered to joint sections 8A of terminal plate 35. Diaphragm 13 is arranged to vibrate in vibrating direction 13F.

Second bar magnet 15 and third bar magnet 115 are placed at both sides of first bar magnet 11 such that longitudinal directions 11A, 15A and 115A are parallel with each other. Magnetic gap 81 is formed between first bar magnet 11 and second bar magnet 15. Magnetic gap 82 is formed between first bar magnet 11 and third bar magnet 115. As shown in FIG. 3, bar magnets 15 and 115 are located obliquely above first bar magnet 11. First bar magnet 11 is magnetized in direction 11B agreeing with vibrating direction 13F of diaphragm 13. Bar magnets 15 and 115 are magnetized in directions 15B and 115B perpendicular to vibrating direction 13F, respectively.

Upper case 6 includes case body 6A having a squared-U shape, upper cover 6B for covering an opening of case body 6A having a frame shape, side cover 6C for covering a front of case body 6A, side cover 6D opposite to side cover 6C, side cover 6E for covering a side of case body 6A, side cover 6F opposite to side cover 6E. Terminal plate 35 is provided on case body 6A by insert molding with resin. Upper cover 6B is made of non-magnetic material, such as stainless steel, provides upper surface 34A of case 34. Side cover 6C has sound holes 7 at both ends thereof. Sound holes 7 communicate with spaces 74 and 75 and face paces 74 and 75, respectively. Yoke 116 coupled to side cover 6C and yoke 16 coupled to side cover 6D are accommodated in upper case 6 of case 34. Yoke 16 is jointed onto outer surface 15D of second bar magnet 15. Yoke 116 is jointed onto outer surface 115D of third bar magnet 115. Bar magnets 15 and 115 contact upper cover 6B.

Yoke 10 having first bar magnet 11 and plate 12 assembled therewith is attached to case 5. Then, diaphragm 13 having voice coil 14 mounted thereto is attached to lower case 5. Then, upper case 6 having second bar magnet 15 and third bar magnet 115 joined thereto is attached to lower case 5, thus assembling loudspeaker 33.

Diaphragm 13 is located between first bar magnet 11 and second bar magnet 15 and between first bar magnet 11 and third bar magnet 115. Vibration spaces 74 and 75 having relatively large volumes are formed around ends 13D and 13E of diaphragm 13 in longitudinal direction 13B, respectively. First bar magnet 11 does not exist in vibration space 74 or 75. Second bar magnet 15 does not exist in vibration space 74 or 75.

As described above, step portion 5B of lower case 5 is flush with yoke 10. Similarly, side covers 6E and 6F are flush with yokes 16 and 116. Outer periphery 13A of diaphragm 13 is held between step portion 5B of lower case 5 and side cover 6E of upper case 6, between step portion 5B of lower case 5 and side cover 6F of upper case 6, between shoulder 10A of yoke 10 and yoke 16, and between shoulder 10A of yoke 10 and yoke 116. Shoulders 10A of yoke 10 face yokes 16 and 116 closely across outer periphery 13A of diaphragm 13, respectively, thereby coupling magnetically first bar magnet 11 to second bar magnet 15 and coupling magnetically first bar magnet 11 to third bar magnet 115.

In loudspeaker 33, two bar magnets 11 and 15 form first magnetic gap 81, and two magnets 11 and 115 form second magnetic gap 82. Magnetic gaps 81 and 82 generate strong magnetic field therein. Bar magnets 15 and 115 are located obliquely above bar magnet 11 to form magnetic gaps 81 and 82. This arrangement provides loudspeaker 33 with a thin, small size.

Case 34 having the rectangular parallelepiped shape enhances the space factor of loudspeaker 33.

The shape of diaphragm 13 will be described below in detail. Diaphragm 13 has surface 13G and surface 13H opposite to surface 13G. Surface 13G faces second bar magnet 15 and third bar magnet 115. Surface 13H faces first bar magnet 11. Diaphragm 13 has projection 13K and vibrating portion 13J provided around projection 13H. Projection 13K is located apart from outer periphery 13A. Projection 13K projects from surface 13G. Vibrating portion 13J has outer periphery 13A. Projection 13K extends in longitudinal direction 13B and has sidewall 13L and end 13M. Voice coil 14 is secured to sidewall 13L of projection 13K. Surface 11C of first bar magnet 11 faces toward end 13M of projection 13K. Inner surface 15C of second bar magnet 15 and inner surface 115C of third bar magnet 115 face toward sidewall 13L of projection 13K.

Upper cover 6B of upper case 6 of case 34 is parallel with vibrating portion 13J of diaphragm 13. Side cover 6C of upper case 6 of case 34 having sound holes 7 provided therein is perpendicular to vibrating portion 13J.

Figure 6:
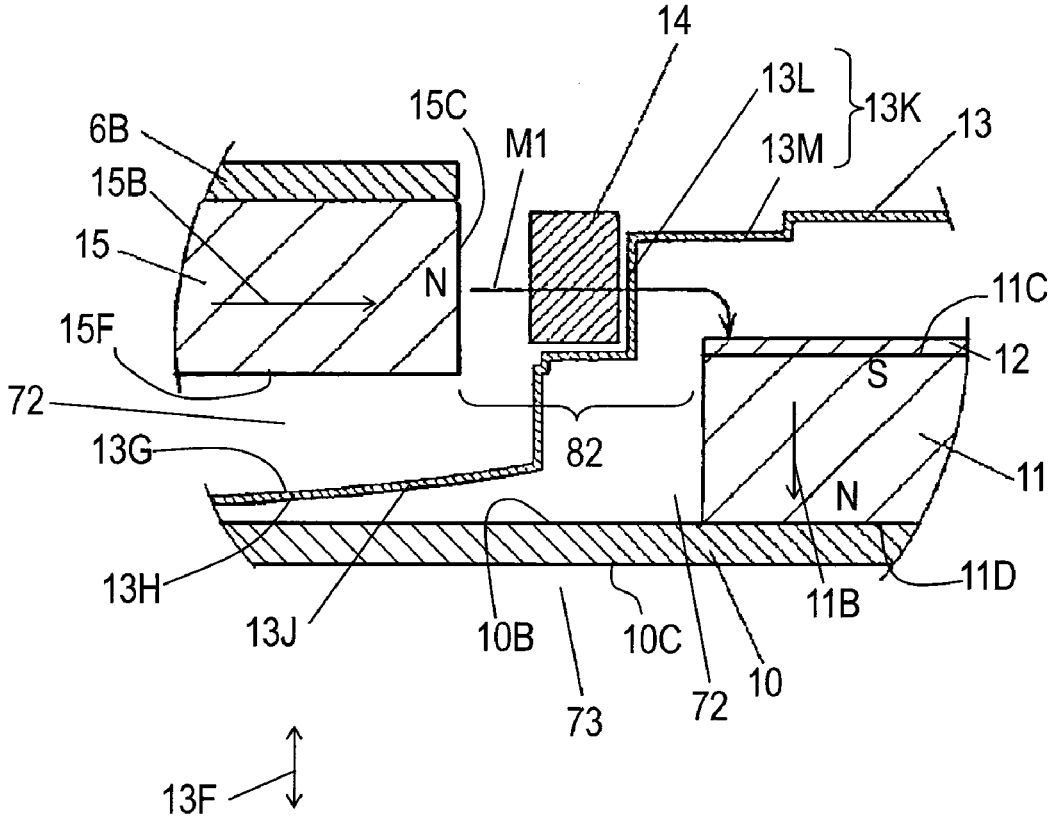
FIG. 6 is an enlarged cross-sectional view of the loudspeaker according to the embodiment.

FIG. 6 is an enlarged cross-sectional view of loudspeaker 33 for illustrating the vicinity of magnetic gap 81. Direction 11B in which first bar magnet 11 is magnetized agrees with the widthwise direction of bar magnet 11. Upper surface 11C is magnetized as an S-pole. Lower surface 11D having yoke 10 jointed thereto is magnetized as an N-pole. Second bar magnet 15 is magnetized in the widthwise direction thereof that is perpendicular to longitudinal direction 15A. Inner surface 15C is magnetized as an N-pole, and outer surface 15D is magnetized as an S-pole.

Magnetic flux generally extends perpendicularly to a magnetized surface. As is shown in FIG. 6, magnetic flux M1 coming out of inner surface 15C, a first magnetized surface of second bar magnet 15 magnetized as an N-pole, flows substantially in a horizontal direction, crosses voice coil 14 substantially perpendicularly, and enters perpendicularly into upper surface 11C, a first magnetized surface of first bar magnet 11 magnetized as an S-pole. Bar magnets 11 and 15 are arranged horizontally or substantially horizontally. As shown in FIG. 3, bar magnets 11 and 15 partly overlap in a horizontal direction, or magnets 11 and 15 do not overlap in the horizontal direction but are located close to each other. Bar magnets 11 and 15 are arranged substantially in the horizontal direction so that magnetic flux M1 flows substantially perpendicularly to voice coil 14. Surface 11C of first bar magnet 11 facing diaphragm 13 in vibrating direction 13F does not face toward inner surfaces 15C and 115C of magnets 15 and 115, and thus, deviates from inner surfaces 15C and 115C. Surface 15F and 115F of bar magnets 15 and 115 facing diaphragm 13 do not face toward first bar magnet 11, and thus, deviate from bar magnet 11.

Magnetic flux coming from lower surface 11D, a second surface of magnet 11 magnetized as an N-pole flows along yoke 10, flows through yoke 16 that is magnetically coupled to shoulder 10A of yoke 10, and enters into outer surface 15D, a second surface of bar magnet 15 magnetized as an S-pole.

Thus, yokes 10 and 16 are coupled magnetically to lower surface 11D of first bar magnet 11 and outer surface 15D as the second magnetized surface of second bar magnet 15. Yokes 10 and 116 are coupled magnetically to lower surface 11D of first bar magnet 11 and outer surface 115D as the second magnetized surface of third bar magnet 115. This arrangement allows magnetic flux M1 to flow through magnets 11 and 15 and yokes 10 and 16, thus providing a magnetic circuit. This magnetic circuit has first magnetic gap 81 formed between inner surface 15C of second bar magnet 15 and upper surface 11C of first bar magnet 11, i.e., plate 12. Second magnetic gap 82 is formed between inner surface 115C as the first magnetized surface of third bar magnet 115 and upper surface 11C as the first magnetized-surface of first bar magnet 11, i.e., plate 12. The magnetic flux in magnetic gaps 81 and 82 and a current flown into voice coil 14 from an external circuit via terminal section 8B, joint section 8A, and ends 14A applies an electromagnetic-field driving force to voice coil 14. The force causes diaphragm 13 having voice coil 14 fixed thereto to vibrate in vibrating direction 13F, thereby generating sounds.

Figure 7:
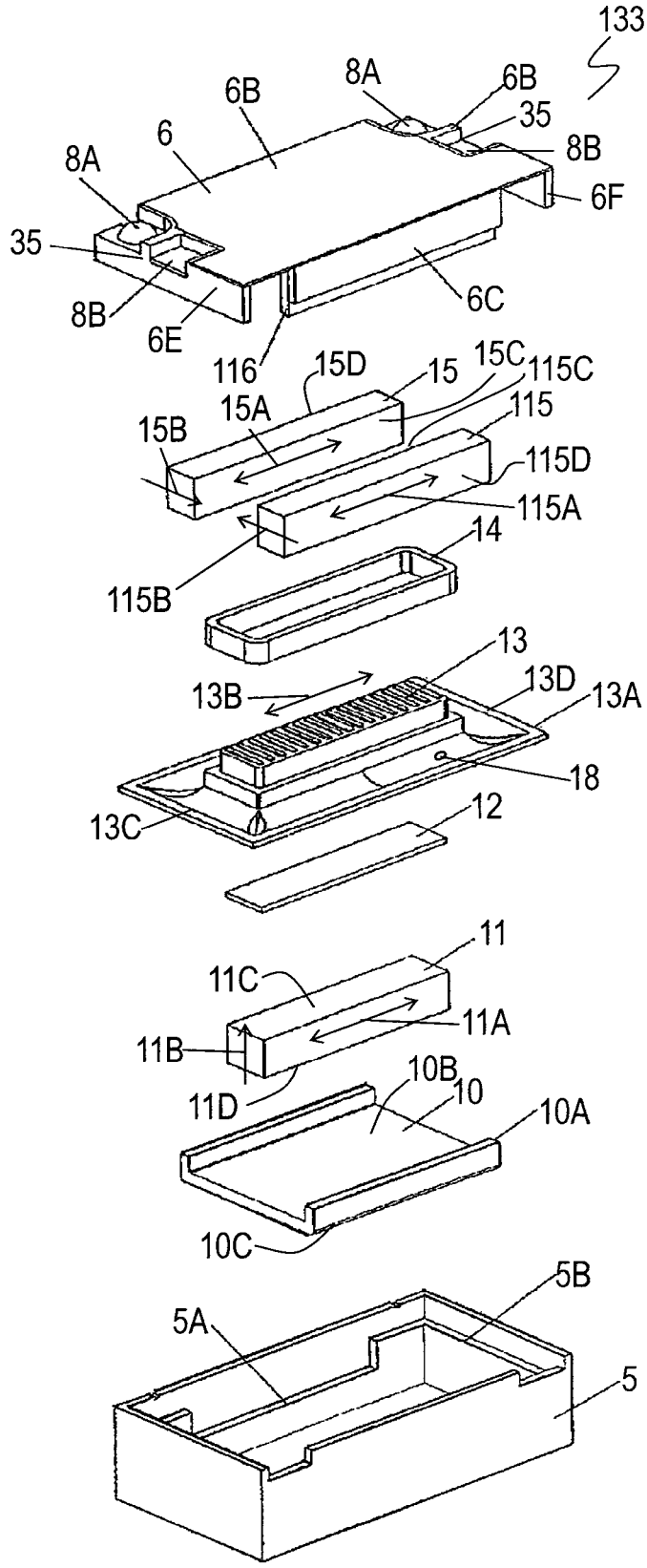
FIG. 7 is an exploded perspective view of another loudspeaker according to the embodiment.

FIG. 7 is an exploded perspective view of another loudspeaker 133 according to the embodiment. In FIG. 7, components identical to those shown in FIGS. 1 to 6 are denoted by the same reference numerals, and their description will be omitted. Diaphragm 13 of loudspeaker 133 has through-hole 18 provided therein.

As is shown in FIG. 4, diaphragm 13 divides the space inside case 34 into two spaces 72 and 73. Surface 13G of diaphragm 13 faces space 72. Surface 13H of diaphragm 13 faces space 73. Spaces 74 and 75 face surface 13G at vibrating portion 13J. Loudspeaker 33 shown in FIGS. 1 to 6 is thin, and accordingly, causes magnetic gaps 81 and 82 to be small, inevitably having a small distance between bar magnets 11, 15, and 115 and diaphragm 13 fixed to voice coil 14. This arrangement may attach diaphragm 13 onto bar magnet 11, 15, or 115. Space 73 is enclosed hermetically with diaphragm 13 and lower case 5. Hence, air in this space may be expanded or compressed due to an ambient temperature, thereby attaching diaphragm 13 onto bar magnet 11, 15, or 115.

In loudspeaker 133 shown in FIG. 7, through-hole 18 provided in diaphragm 13 allows spaces 72 and 73 to communicate with each other. This prevents space 73 from being hermetic, and adjusts a pressure in space 73. This prevents diaphragm 13 from be attached onto bar magnet 11, 15, or 115.

INDUSTRIAL APPLICABILITY

A loudspeaker according to the present invention is thin but outputs large sounds, thus being useful for mobile devices, such as mobile phones.

The invention claimed is:

1. A loudspeaker comprising:

a first bar magnet having a longitudinal direction;

a second bar magnet having a longitudinal direction parallel to the longitudinal direction of the first bar magnet, the second bar magnet forming a first magnetic gap between the first bar magnet and the second bar magnet, the second bar magnet having both ends in the longitudinal direction;

a third bar magnet having a longitudinal direction parallel to the longitudinal direction of the first bar magnet, the third bar magnet forming a second magnetic gap between the first bar magnet and the third bar magnet, the third bar magnet having both ends in the longitudinal direction;

a diaphragm located between the first bar magnet and the second bar magnet and between the first bar magnet and the third bar magnet, the diaphragm having an outer periphery, the diaphragm being arranged to vibrate in a vibrating direction;

a case made of non-magnetic material and accommodating the first bar magnet, the second bar magnet, the third bar magnet, and the diaphragm, the case holding the outer periphery of the diaphragm, wherein the case forms a first space surrounded by the case, one of the both ends of the second bar magnet, and one of the both ends of the third bar magnet, wherein the case forms a second space surrounded by the case, another one of the both ends of the second bar magnet, and another one of the both ends of the third bar magnet, and wherein a first sound hole and a second sound hole are provided in the case and communicate with the first space and the second space, respectively;

a voice coil fixed to the diaphragm, the voice coil located in the first magnetic gap and the second magnetic gap;

a first yoke contacting the first magnet;

a second yoke contacting the second magnet; and a third yoke contacting the third magnet, wherein the first bar magnet has a first magnetized surface facing the first magnetic gap and the second magnetic gap, and has a second magnetized surface opposite to the first magnetized surface of the first bar magnet, the second bar magnet has a first magnetized surface facing the first magnetic gap, and has a second magnetized surface opposite to the first magnetized surface of the second bar magnet, the third bar magnet has a first magnetized surface facing the second magnetic gap, and has a second magnetized surface opposite to the first magnetized surface of the third bar magnet, the first yoke and the second yoke contact the second magnetized surface of the first magnet and the second magnetized surface of the second magnet, respectively, and hold a periphery of the diaphragm between the first yoke and the second yoke as to face each other across the periphery of the diaphragm, such that the second magnetized surface of the first bar magnet is magnetically coupled to the second magnetized surface of the second bar magnet, and the first yoke and the third yoke contact the second magnetized surface of the first magnet and the second magnetized surface of the third magnet, respectively, and hold a periphery of the diaphragm between the first yoke and the third yoke as to face each other across the periphery of the diaphragm, such that the second magnetized surface of the first bar magnet is magnetically coupled to the second magnetized surface of the third bar magnet.

2. The loudspeaker of claim 1, wherein the first bar magnet is magnetized in the vibrating direction, and the second bar magnet and the third bar magnet is magnetized in a direction perpendicular to the vibrating direction.

3. The loudspeaker of claim 1, wherein the voice coil has a first end and a second end arranged to have a current flowing in the voice coil applied thereto, said loudspeaker further comprising a terminal plate having a first terminal and a second terminal, the first terminal being connected to the first end in the first space, the second terminal being connected to the second end in the second space.

4. The loudspeaker of claim 1, wherein the diaphragm divides a space inside the case into two spaces, and the diaphragm has a through-hole provided therein to allow the two spaces to communicate with each other.

5. The loudspeaker of claim 1, wherein the first bar magnet and the second bar magnet at least partly overlap in a horizontal direction.

6. The loudspeaker of claim 1, wherein a width of the voice coil in the vibrating direction is smaller than a width of the first magnetized surface of the second bar magnet in the vibrating direction, and the voice coil is entirely positioned within the width of the first magnetized surface of the second magnet in the vibrating direction.

7. The loudspeaker of claim 6, wherein a width of the voice coil in the vibrating direction is smaller than a width of the first magnetized surface of the third bar magnet in the vibrating direction, and the voice coil is entirely positioned within the width of the first magnetized surface of the third magnet in the vibrating direction.

8. A loudspeaker comprising:

a first bar magnet having a longitudinal direction;

a second bar magnet having a longitudinal direction parallel to the longitudinal direction of the first bar magnet, the second bar magnet forming a first magnetic gap between the first bar magnet and the second bar magnet, the second bar magnet having both ends in the longitudinal direction;

a third bar magnet having a longitudinal direction parallel to the longitudinal direction of the first bar magnet, the third bar magnet forming a second magnetic gap between the first bar magnet and the third bar magnet, the third bar magnet having both ends in the longitudinal direction;

a diaphragm located between the first bar magnet and the second bar magnet and between the first bar magnet and the third bar magnet, the diaphragm having an outer periphery, the diaphragm being arranged to vibrate in a vibrating direction;

a case made of non-magnetic material and accommodating the first bar magnet, the second bar magnet, the third bar magnet, and the diaphragm, the case holding the outer periphery of the diaphragm, wherein the case forms a first space surrounded by the case, one of the both ends of the second bar magnet, and one of the both ends of the third bar magnet, wherein the case forms a second space surrounded by the case, another one of the both ends of the second bar magnet, and another one of the both ends of the third bar magnet, and wherein a first sound hole and a second sound hole are provided in the case and communicate with the first space and the second space, respectively; and a voice coil fixed to the diaphragm, the voice coil located in the first magnetic gap and the second magnetic gap, wherein the first bar magnet and the second bar magnet at least partly overlap in a horizontal direction.

9. A loudspeaker comprising:

a first bar magnet having a longitudinal direction;

a second bar magnet having a longitudinal direction parallel to the longitudinal direction of the first bar magnet, the second bar magnet forming a first magnetic gap between the first bar magnet and the second bar magnet, the second bar magnet having both ends in the longitudinal direction;

a third bar magnet having a longitudinal direction parallel to the longitudinal direction of the first bar magnet, the third bar magnet forming a second magnetic gap between the first bar magnet and the third bar magnet, the third bar magnet having both ends in the longitudinal direction;

a diaphragm located between the first bar magnet and the second bar magnet and between the first bar magnet and the third bar magnet, the diaphragm having an outer periphery, the diaphragm being arranged to vibrate in a vibrating direction;

a case made of non-magnetic material and accommodating the first bar magnet, the second bar magnet, the third bar magnet, and the diaphragm, the case holding the outer periphery of the diaphragm, wherein the case forms a first space surrounded by the case, one of the both ends of the second bar magnet, and one of the both ends of the third bar magnet, wherein the case forms a second space surrounded by the case, another one of the both ends of the second bar magnet, and another one of the both ends of the third bar magnet, and wherein a first sound hole and a second sound hole are provided in the case and communicate with the first space and the second space, respectively; and a voice coil fixed to the diaphragm, the voice coil located in the first magnetic gap and the second magnetic gap, wherein the first bar magnet has a first magnetized surface facing the first magnetic gap and the second magnetic gap, and has a second magnetized surface opposite to the first magnetized surface of the first bar magnet, the second bar magnet has a first magnetized surface facing the first magnetic gap, and has a second magnetized surface opposite to the first magnetized surface of the second bar magnet, the third bar magnet has a first magnetized surface facing the second magnetic gap, and has a second magnetized surface opposite to the first magnetized surface of the third bar magnet, a width of the voice coil in the vibrating direction is smaller than a width of the first magnetized surface of the second bar magnet in the vibrating direction, and the voice coil is entirely positioned within the width of the first magnetized surface of the second magnet in the vibrating direction.

10. The loudspeaker of claim 9, wherein a width of the voice coil in the vibrating direction is smaller than a width of the first magnetized surface of the third bar magnet in the vibrating direction, and the voice coil is entirely positioned within the width of the first magnetized surface of the third magnet in the vibrating direction.

* * * * *